US006836216B2

(12) United States Patent
Manov et al.

(10) Patent No.: US 6,836,216 B2
(45) Date of Patent: Dec. 28, 2004

(54) ELECTRONIC ARTICLE SURVEILLANCE SYSTEM

(75) Inventors: Vladimir Manov, Haifa (IL); Alexander Rubshtein, Ashkelon (IL); Edward Brook-Levinson, Petakh-Tikya (IL)

(73) Assignee: Electronic Article Surveillance Technologies, Ltd., Netania (IL)

( * ) Notice: Subject to any disclaimer, the term of this patent is extended or adjusted under 35 U.S.C. 154(b) by 162 days.

(21) Appl. No.: 10/142,096

(22) Filed: May 9, 2002

(65) Prior Publication Data

US 2003/0210145 A1 Nov. 13, 2003

(51) Int. Cl.[7] ..... G08B 13/14

(52) U.S. Cl. ..... 340/572.7; 340/572.4; 340/572.8; 340/572.9; 343/700 R; 343/893

(58) Field of Search ..... 340/572.7, 572.1, 340/572.3, 572.4, 572.5, 572.8, 572.9; 343/700 R, 893, 866

(56) References Cited

U.S. PATENT DOCUMENTS

| | | | | |
|---|---|---|---|---|
| 3,990,065 A | | 11/1976 | Purinton et al. | |
| RE29,610 E | * | 4/1978 | Minasy et al. | 340/522 |
| 4,118,693 A | | 10/1978 | Novikoff | |
| 4,274,090 A | | 6/1981 | Cooper | |
| 4,539,558 A | | 9/1985 | Fearon | |
| 4,859,991 A | | 8/1989 | Watkins et al. | |
| 4,963,880 A | * | 10/1990 | Torre et al. | 343/866 |
| 4,972,198 A | * | 11/1990 | Feltz et al. | 340/572.7 |
| 5,103,234 A | * | 4/1992 | Watkins et al. | 343/742 |
| 5,276,430 A | * | 1/1994 | Granovsky | 340/572.4 |
| 5,327,118 A | * | 7/1994 | Drucker et al. | 340/571 |
| 5,414,410 A | * | 5/1995 | Davies et al. | 340/551 |
| 5,440,296 A | * | 8/1995 | Nelson | 340/572.7 |
| 5,459,451 A | | 10/1995 | Crossfield et al. | |
| 5,627,516 A | * | 5/1997 | Balch et al. | 340/572.1 |
| 5,900,816 A | * | 5/1999 | Weaver | 340/572.2 |
| 6,081,238 A | * | 6/2000 | Alicot | 343/742 |

FOREIGN PATENT DOCUMENTS

EP 0 153 286 B1 8/1985

* cited by examiner

*Primary Examiner*—Jeffery Hofsass
*Assistant Examiner*—Daniel Prévil
(74) *Attorney, Agent, or Firm*—Shalom Wertsberger; Saltamar Innovations

(57) ABSTRACT

An electronic article surveillance system is disclosed. The system utilizes interaction between magnetic fields generated by a plurality of antennae elements to generate magnetic field in different orientations within an interrogation zone. The antenna elements are fed in different phases in accordance to phase patterns to generate the different orientations. A novel receiving antenna construction for receiving the perturbations caused by re-magnetization of a marker within the interrogation zone is also disclosed. The antenna construction comprises a receiving coil at a certain distance from the transmitting coil, and a compensating coil closer to a transmitting coil. A method for utilizing the system is also presented.

21 Claims, 6 Drawing Sheets

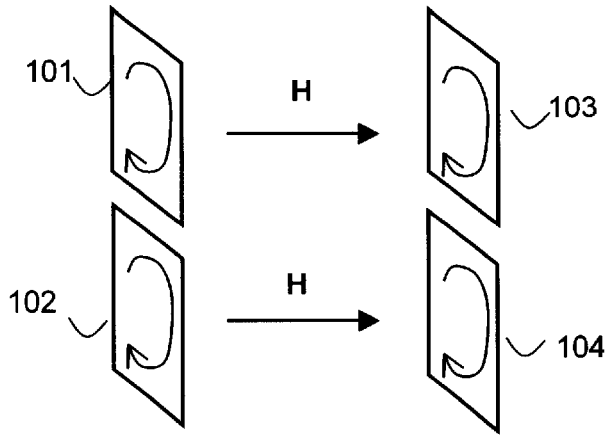
Fig. 4a "Orthogonal" polarization
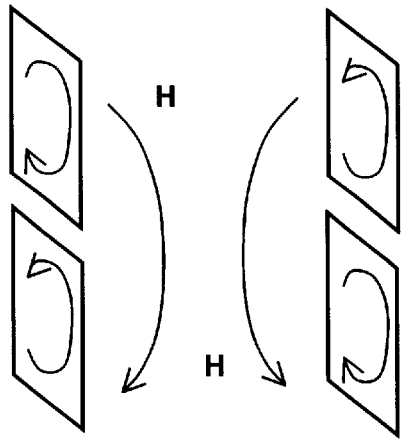
Fig. 4b "FLAT" polarization
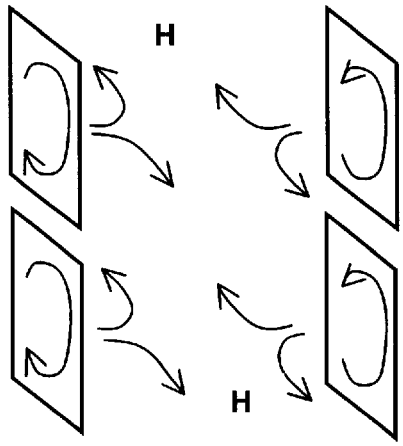
Fig. 4c "FRONT" polarization

ELECTRONIC ARTICLE SURVEILLANCE SYSTEM

FIELD OF THE INVENTION

The present invention relates to electronic article surveillance systems and more specifically, to electronic article surveillance systems which detects markers in an interrogation zone

BACKGROUND OF THE INVENTION

Electronic article surveillance (EAS) systems of the magnetic type are extensively described in the art. In such systems, a magnetic marker having a specific non-linear response is attached to an article under surveillance. An alternating magnetic field is generated by an antennae system in an interrogation zone. If an article carrying a marker passes through the zone, perturbations are created in the magnetic field. These perturbations are sensed by receiver antenna coils, and the corresponding electrical signals are analyzed by a detector unit. An alarm is activated in response to particular signal pattern.

Several methods for article surveillance have been described. One such system uses magnetic markers having a hysteresis loop with large Barkhausen discontinuities. Such systems are available from Sensormatic Electronics Co. of Boca Raton, Fla., USA. The operation of a typical system operating under this principle is disclosed in U.S. Pat. No. 4,859,991 to Watkins et al. and the patents cited therein. Since the marker exhibits a step function reversal of its magnetization when exposed to a low frequency interrogation magnetic field above a certain threshold, the perturbations of the received signal are rich in high order (about 20 to 100) harmonics that can be easily distinguished from signals generated by other ferrous objects.

While this system provides detection capabilities, it requires relatively large marker sizes (over 45 mm, and typically 90 mm length) to provide reliable detection. Use of high order harmonics for detection results in relatively low sensitivity, as only a small portion of the marker response energy is available at such harmonics. Consequently, in practical use the aisle width in the interrogation zone is decreased to 80 cm or less, depending on the noise level in the environment.

Esselte Meto GMbH, of Heppenheim, Germany, produces another system type. This system uses amorphous magnetic markers characterized by very low coercivity and high permeability. Variants of such system embodiments are disclosed in U.S. Pat. No. 5,414,410 to Davies et al. and EP 0153286 to Esselte Meto EAS International AB. Generally, transmitting antennae generate magnetic fields of two or three different frequencies, and the marker nonlinear response results in intermodulation products of these frequencies that are detected by the signal processing unit. The Meto systems feature high sensitivity at rather wide aisles (up to 120 cm) and relatively small markers (32 mm typical length).

Both systems exhibit poor detection characteristics when the marker is passed in a plane parallel to antennae or within a small angle (20–30 degrees) to that plane. Another common problem is poor or no detection of markers attached to highly conductive objects (aluminum, copper), as relatively high frequency (10–12 KHz) intermodulation response signals of the marker are suppressed by induced eddy currents in the conductive object.

Intrinsic disadvantage in the above described systems are low or zero sensitivity zones, commonly referred to as 'dead zones', exhibited within the detection zones. Typically, the receiving antennae coils in such systems are constructed in figure eight shape. Generally, dead zones are present in the area near the intersection of the figure eight shape. Attempts to eliminate this disadvantage by more sophisticated configurations of the receiver antenna coils like those described in U.S. Pat. No. 5,459,451 to crossfield et al. result in cumbersome and expensive antenna structures. Purinton et al. in U.S. Pat. No. 3,990,065, attempted to increase detection by varying the spatial orientation of the magnetic field by increasing the number of the antennae coils, also resulting in cumbersome and expensive antenna structures.

Recent trends in prevention of shoplifting are towards the use of small, thin and flexible markers at maximum attainable aisle width, which requires the highest system sensitivity in the harsh interference conditions of the point of sale. Also, fast growth of source tagging technologies makes it desirable for an EAS system to be operable with different marker types, be those of a harmonic type (like those of Meto) or Barkhausen type (like those of Sensormatic), or any other applicable marker.

BRIEF DESCRIPTION

It is an aim of the present invention to provide an electronic article surveillance system with improved design that allows highly reliable detection of markers in any orientation, and along any trajectory within the interrogation zone.

Amongst other parameters, the preferred embodiment of the invention achieves better detection capabilities providing excitation signals in a plurality of polarization planes, while requiring only a minimum of four transmitting antennae coils. By providing excitation in multiple planes, the marker almost always receives sufficient energy for activation regardless of its orientation. The magnetic field orientation is varied by simultaneously feeding current to the antennae coils in varying polarities. Varying polarity patterns, or phase patterns, are selected to cause different orientations of the magnetic field due to field interaction between the fields generated by any two or more antennae coils.

Thus, in a broad aspect of the invention two substantially parallel antennae arrays are provided, forming an interrogation zone between the arrays. Each array comprising at least two substantially coplanar antenna elements, each having at least one transmitting coil. A phase sequencer is adapted to feed power to the antennae coils in varying phase patterns and is coupled to them. The patterns are selected to produce magnetic field of different spatial orientations, by magnetic field interaction between the magnetic fields generated by at least one pair of antenna coils. Thus at least one of the patterns is selected to cause the instantaneous current in a first coil to flow in an opposite direction to the instantaneous current in a second coil, so as to generate a field induced by the first coil, that is of different spatial orientation than the field of the second coil, and the interaction therebetween causes a magnetic field of a third orientation. The phase sequencer switches between the phase patterns, in a time dependent fashion.

The term phasing as used in this application relates to the relationship between the orientation of the magnetic field generated by a first coil and the orientation of the magnetic field generated by a second coil, or to the currents that cause such magnetic fields. The product of the interaction between a plurality of field is the result of phasing and may take different spatial orientation from the first and the second field.

In accordance with the preferred embodiment of the invention, the different spatial orientation of the magnetic field are provided by using a plurality of transmitting coils wherein the phases of alternating current in the coils are switched in accordance with the pre-determined timing sequence.

In the preferred embodiment, at least one of the antennae elements, and more preferably each of the antenna elements also comprise a receiving coil. In the most preferred embodiment, each antenna element has also a compensator coil, located at closer proximity to the transmitting coil than the proximity of the receiving coil and having fewer turns then those of the receiving coil, each receiving coil coupled to a corresponding com[pensating coil. The coupling between the coils is done in opposite polarity, so that the voltage induced by the transmitting coil in one coil will be substantially neutralized by the voltage induced in the other. The coupled coils form a receiving element. The receiving elements, or in a minimal embodiment only the receiving antennae, are coupled to a receiver and a signal processor, which in turn analyses the signals received by the antenna and determines the presence of a marker in the interrogation zone. The receiver and signal processor may be integrated.

Optionally, digital signal processing is used to improve detection and avoid false alarms. In this digital processing, a sliding window in combination with a pre-determined model of the expected marker response, is utilized to determine if a received response was generated by the presence of a marker in the interrogation zone.

Further disclosed is a method for detecting the presence of a marker within an interrogation zone, the method comprising the steps of feeding current to a plurality of transmitting coils in varying phase patterns. A first pair of transmitting coils are arranged in a first antenna array, and a second pair of transmitting coils are arranged in a second antenna array, substantially parallel to said first antenna array. The two arrays form an interrogation zone therebetween. The phase patterns are selected to cause a different spatial orientation of the magnetic field in the interrogation zone for specific different phase patterns. Modifying said phase patterns in a time dependent manner. Sensing magnetic perturbations caused by the presence of a marker in the interrogation zone, analyzing signals resulting from said sensing; and, outputting an indication if said step of analysis determines that a marker is present within the interrogation zone.

Preferably, the step of sensing is performed utilizing a receiving coil and a compensating coil located in the antennae array, wherein the output of said receiving coil is coupled to the output of said compensating coil at opposite polarity. The preferred construction of the receiving antenna elements was provided elsewhere in these specifications. More preferably the step of sensing is performed using receiver and signal processor, which may be integrated. Most preferably the method also comprises the step of comparing the received magnetic field perturbations to a pre-determined model of the expected marker response.

BRIEF DESCRIPTION OF THE DRAWINGS

The present invention may be better understood by referring to the accompanied drawings, in which:

FIG. 4 is a schematic view of transmitted magnetic field configurations in different phases or phase patterns of the system operation in accordance with the preferred embodiment of the present invention;

DETAILED DESCRIPTION

Figure 1:
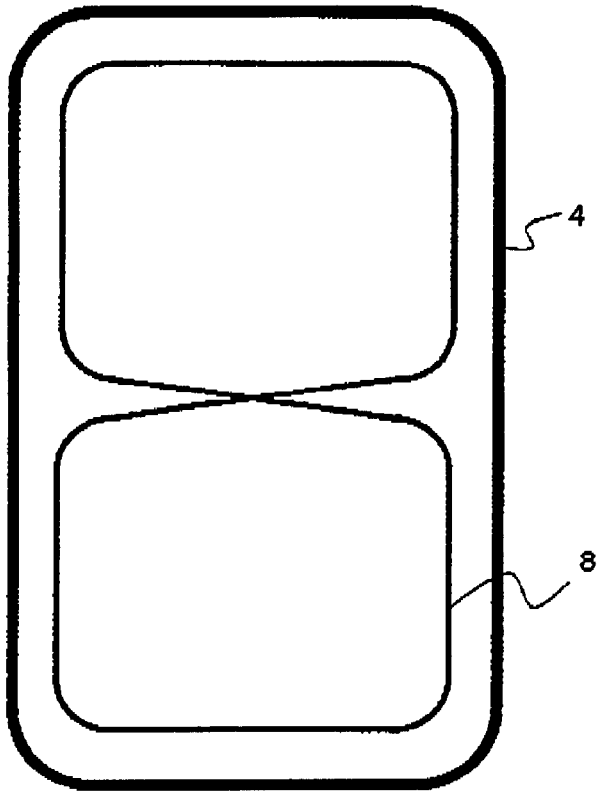
Prior Art FIG. 1
FIG. 1 is a plane view of a transceiver antenna known in the art.

A number of preferred embodiments and aspects of the invention will be discussed below, referring to the drawings as applicable. In FIG. 1, a typical configuration of a transceiver type antenna known in the art is presented in a schematic plane view. Alternating current flowing in the transmitter coil 4 produces the interrogation magnetic field. The receiving coil 8 is typically formed to generally resemble the figure eight, so that in an undisturbed environment, the voltages induced in each half of the coil have equal value and opposite polarity to the voltage induced in the other half, and therefore the voltage induced in each half substantially cancels the other, resulting in zero output. (In these specifications, unless otherwise indicated or clear from the context, a zero, or null, result or output, signifies a result or output sufficiently close to zero, and a non-zero, or non-null result or output, signifies a result sufficiently apart from zero, so as to permit separating one result as opposed to the other.) When a marker is placed near one of the receiving coil halves, the field disturbances created by its re-magnetization induces a relatively strong voltage signal in the closest half of the receiving coil whereas the voltage of the opposite sign induced in the farthest half is much weaker, resulting in non-null output.

However, if a marker is placed symmetrically with respect to the receiving coil halves, then the resulting output will be zero. Thus this type of antennae construction suffers inherently from at least one dead zone near the intersection of the figure eight halves.

Figure 2A:
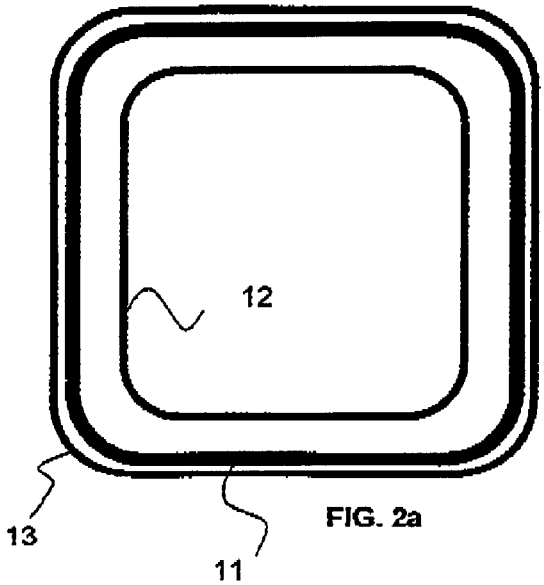
FIGS. 2*a* and 2*b* are respectively a plane view and a partial section view of one of the transceiver antenna coil assemblies in accordance with the preferred embodiment of the present invention.
Figure 2B:
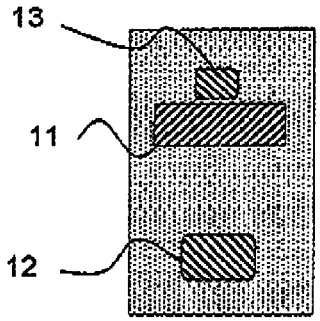

FIG. 2*a* shows a plane view of a transceiver antenna coils assembly in accordance with the preferred embodiment of the present invention. A compensating coil 13 is wound close to the transmitting coil 11, while a receiving coil 12 is placed inside the transmitting coil 11 so that the windings of the receiving coil 12 are farther from the windings of the transmitting coil 11, than those of compensating coil 13. For clarity, an example of this arrangement is shown also in a partial section view in FIG. 2*b*.

Both the receiving coil 12 and the compensating coil 13 are inductively coupled to transmitting coil 11. However due to the distance difference, the coupling is stronger for compensating coil 13 than for receiving coil 12. Accordingly, the voltage induced in a single winding of the compensating coil 13 will be higher than that of a single winding the receiving coil 12. This means that for obtaining equal induced voltages, the number of windings in the receiving coil 12 should be greater than that of the compensating coil 13. A receiving coil connected in opposite polarity to a compensating coil, creates a receiving element that has substantially null output in the presence of excitation only from the transmitting coil.

In a particular example of the antenna embodiment in accordance with the present invention, the transmitting coil 11 has a square shape with 55 cm side length, and it consists of 32 turns of a 2 mm round copper wire. The receiving coil 12 has also a square shape with 45 cm side length, and it consists of 200 turns of a 0.2 mm round copper wire. The compensating coil 13 is wound over the transmitting coil 11, and it consists of 80 turns of a 0.2 mm round copper wire. The compensating coil 13 and the receiving coil 12 are connected in opposite polarities, to form a receiving element as described. When AC current flows in the transmitting coil 11, the resulting output signal from the receiving and compensating coils cancel each other in an undisturbed environment, to produce a null output from the receiving element.

When a marker is placed near the antenna assembly, the field disturbances produced by its re-magnetization induce voltages both in the receiving coil 12 and in the compensating coil 13. The values of these voltages are defined by the relevant magnetic flux through the coils, and the number of turns in the coils. Since the coil areas are but slightly different, and the numbers of turns in the receiving coil 12 is significantly greater than that of the compensating coil, the signal from the marker produces a non-null output in the receiving element It is clear to those skilled in the art that the marker signal will be at maximum in the center of the antenna coil assembly in accordance with the present invention, as opposed to the dead zone exhibited by the antenna of FIG. 1.

Experience in the art shows that for an antenna with a single transmitting coil, as depicted in FIG. 1 the marker is best detected when it is oriented perpendicular to the antenna plane because in this case the interrogating field is mainly directed along the marker axis. It is therefore desirable to provide magnetic field of a plurality of spatial orientations. The most favorable embodiment of the invention provides for periodically (or randomly if desired) alternating the field orientation using interactions between the magnetic fields generated by a plurality of transmitting coils. Preferably, four such coils are provided.

Figure 3:
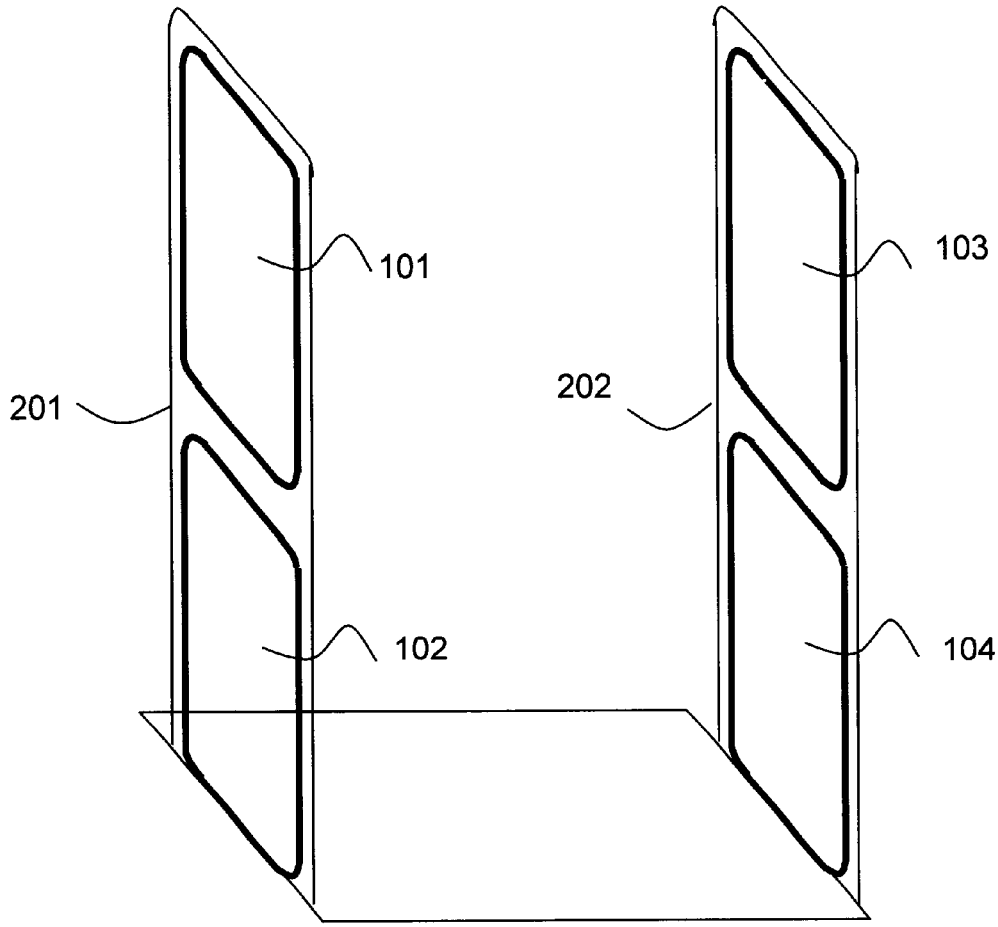
FIG. 3 is a perspective view of an aisle with two parallel antennae arrays, each comprising two coplanar antennae coils.

FIG. 3 shows an example of an EAS aisle formed of two antennae arrays 201 and 202 in accordance with the preferred embodiment of the invention. Each antenna consists of two coil assemblies (101, 102 and 103,104), with every assembly including a transmitting coil, a receiving coil, and a compensating coil, as described above. The antennae 201 and 202 are placed in a spaced-apart parallel relationship.

The current direction, or phases of current in different coil assemblies determine the prevailing direction of the magnetic field. Thus feeding power to the transmitting antenna coils in different patterns, causes the field generated by one coil to interact with the field generated by one or more other coils, and offers the capability to modify the spatial orientation of the magnetic field in the interrogation zone, by switching phase patterns.

FIG. 4 illustrates the field orientations stemming from feeding four transmitting coils in three different phase patterns. In FIG. 4*a* all four coils 101,102,103, and 104 are fed in the same phase, i.e. the direction of current in each is the same at a given time. The magnetic field lines H in the antennae system are mainly directed perpendicular to the antenna planes ("ORT", or orthogonal phase). If the phases in coils 101 and 104 are similar, e.g. "clockwise" flowing currents, and the phases in the coils 102,103 are of the opposite direction ("anti-clockwise"), then the magnetic field lines H are mainly directed vertically ("FLAT" phase) as shown in FIG. 4*b*. FIG. 4*c* depicts a phase pattern where the phases in the first antenna are "clockwise", and the phases in the second antenna are "counter-clockwise". As a result of this phase pattern, the magnetic field lines H are, at least in part, directed parallel to the antenna planes ("FRONT" phase). It will be clear that other phase patterns and feeding combinations are also available, that provide different spatial orientations due to magnetic field interactions.

If the phase patterns are modified periodically at a sufficient speed to expose a marker passed through the interrogation zone to magnetic field radiated in different orientations, the marker will be re-magnetized sufficiently to produce the nonlinear field perturbations that can be detected by the system, regardless of the marker's orientation. Thus the feeding of electrical power to the transmitting coils is controlled by a phase sequencer. The phase sequencer is adapted to feed the different coils in accordance to different phase patterns to generate different spatial orientations of the magnetic field. In the preferred embodiment, the phase sequencer is controlled by computer software, and periodically switches the phase patterns every 25 ms. The design of the phase sequencer will be clear to those skilled in the art, e.g. by using well known H-Bridge switching arrangement. The sequencer may be accomplished by hardware only, as well as software and hardware combination. Such parameters as method of implementing phase patterns, switching patterns, and the like are similarly a matter of technical choice.

Figure 8:
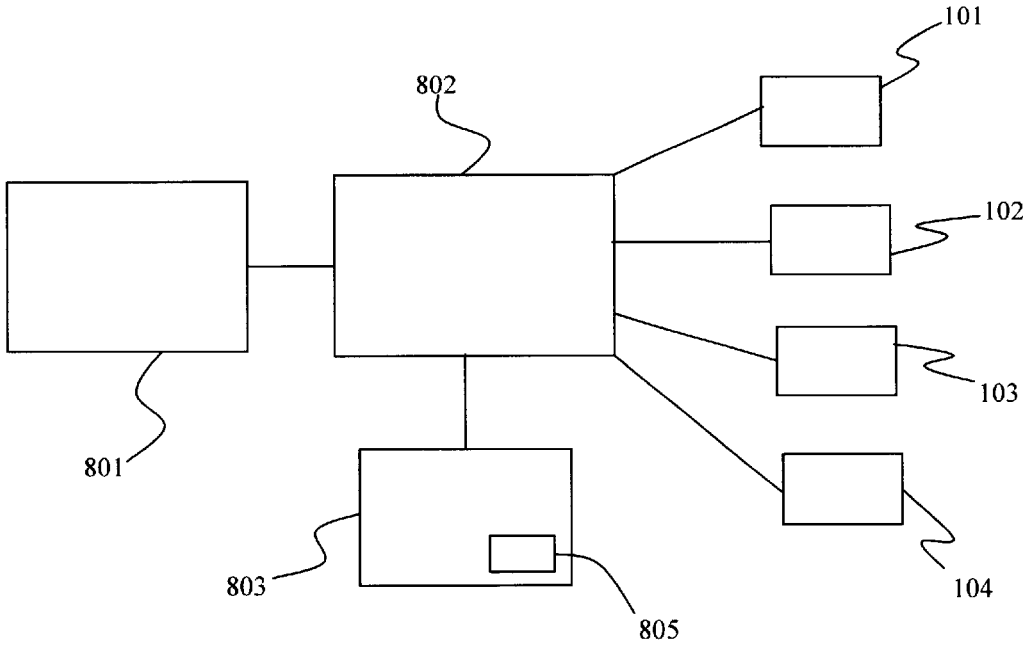
FIG. 8 depicts an example of a simplified transmitter block diagram in accordance with a preferred implementation of the invention.

FIG. 8 depicts an example of a simplified transmitter block diagram. In it, a power supply 801 provides power to the transmitter. Phasing Sequencer 802 feeds power in varying polarities to transmitter coils 101, 102, 103 and 104, under control of computer 803 in accordance with phase patterns and timing dictated by software program 805. The phase sequencer may itself be configured as a transmitter, or a separate transmitter may generate the desired signal and the phasing sequencer functions to switch the signal between the different coils in accordance with the desired phase pattern.

Figure 5:
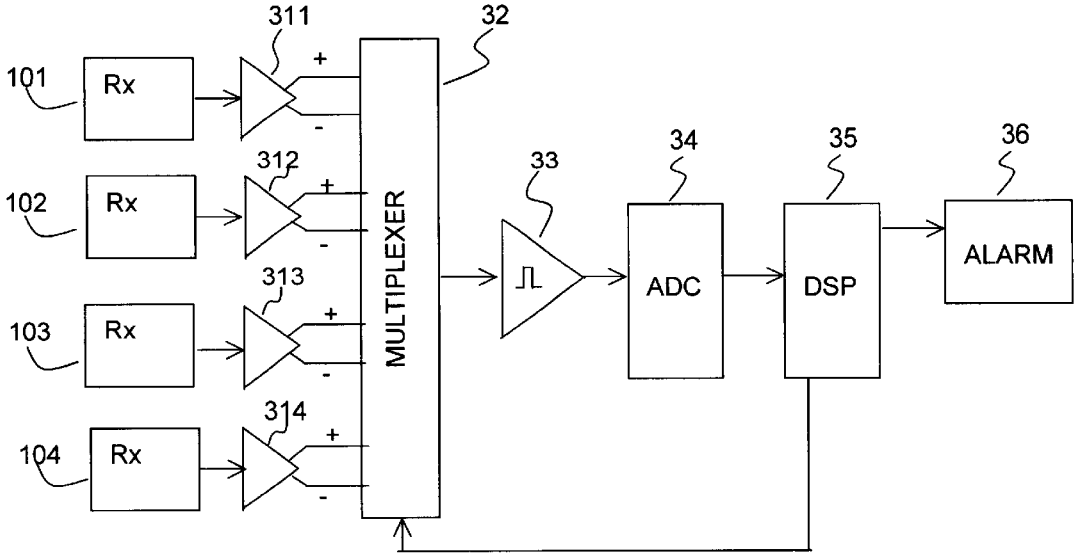
FIG. 5 is an example of a marker detection block diagram according to the present invention.

FIG. 5 depicts a simplified block diagram of the receiving and signal processing parts according to the preferred embodiment of the invention. The received (Rx) signals from the four receiving elements of 101,102,103,104 are fed to pre-amplifiers 311, 312, 313, 314 respectively. Each preamplifier has both inverted and non-inverted (direct) outputs (marked – and + respectively), that are connected to an analog multiplexer/adder 32. The multiplexer/adder 32 output is connected to a band-pass amplifier 33. The output of the band-pass amplifier 33 is connected to the input of an analog-digital converter (ADC) 34. The digitized data outputted by the ADC 34 are fed to a digital signal processor 35, and when the marker is detected in accordance with the pre-determined criteria, the alarm unit 36 is activated.

Preferably, the digital signal processor 35 controls the receiving data handling including control of the adder/multiplexer 32, and the transmission in accordance with the phase patterns. Such arrangement simplifies the coordination of detection operation, so that the phases of pre-amplified Rx signals correspond always to the phases of current in the relevant transmitting coils. This is further illustrated in Table 1 where the signs "+" or "–" correspond to direct or inverted pre-amplifier outputs fed respectively to the adder, for all the three phase states described above.

TABLE 1

| Coil assembly | Phase states | | |
|---|---|---|---|
| No. | ORT | FLAT | FRONT |
| 101 | + | + | + |
| 102 | + | − | + |
| 103 | + | − | − |
| 104 | + | + | − |

In such a way, the signal that is fed to the band-pass amplifier 33 is proportional to a sum of absolute values of all the four received signals, while its polarity corresponds to that of the signal received from the first coil 101.

Figure 6:
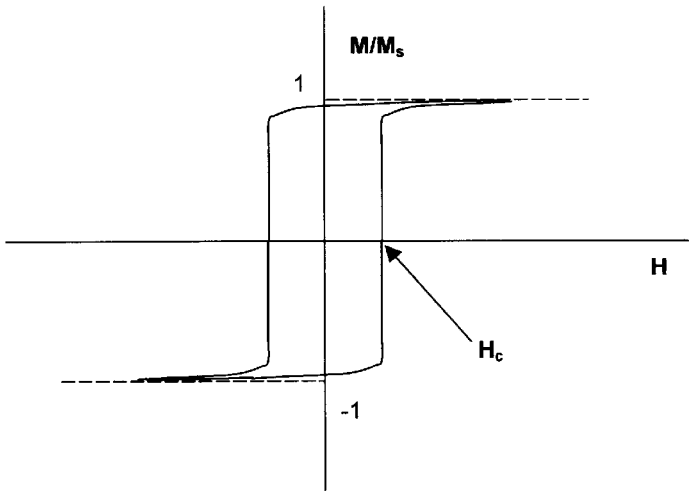
FIG. 6 is a schematic hysteresis loop graph of a magnetic marker.

A typical graph of EAS marker magnetization graph is depicted in FIG. 6. Such markers are preferably characterized by low coercive force Hc values, typically less than 20 A/m, and by high permeability values, typically more than 20,000$\mu_0$. The marker re-magnetization from one saturated state (M/Ms=−1) to another (M/Ms=1) occurs therefore very quickly when the external (interrogation) magnetic field changes. This re-magnetization may also occur as a single Barkhausen discontinuity. For the purposes of the present invention, it is advantageous to have re-magnetization process which occurs like a step function, contrary to those in common ferrous objects where the process is smooth and slow.

Figure 7:
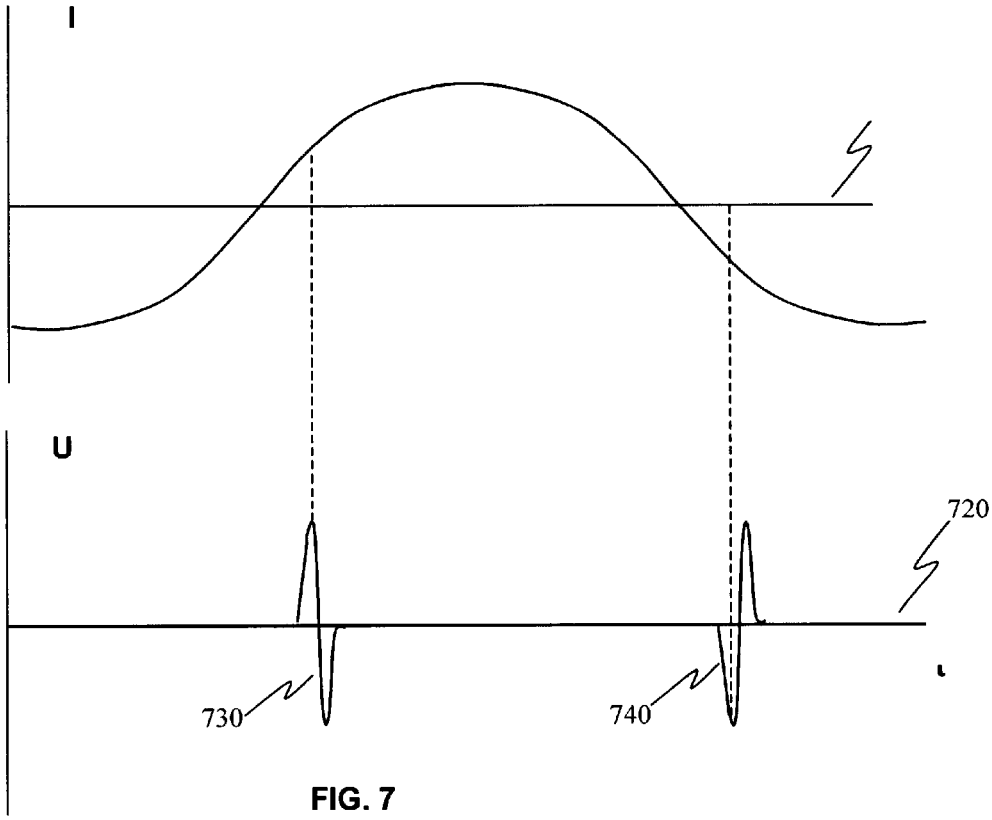
FIG. 7 is a graph of received signal waveform, related to current waveform in the transmitting coil.

FIG. 7 illustrates a waveform of pre-processed analog signal of such marker that can be observed at the output of band-pass amplifier 33 depicted in FIG. 5, related to the waveform of current in a transmitting coil. The current in the coil, is depicted by the top graph 710 and the marker signal by the lower graph 720. While the actual waveform in the transmitting coil may be of any convenient waveform, a sinusoidal waveform is used in the drawing for simplicity.

The band-pass amplifier 33 suppresses the components of main frequency and low order harmonics in the transmitted Rx signal. These components are less informative, as they are typical also for common ferrous objects. In a particular example embodiment in accordance with the present invention, the main frequency is chosen to be 200 Hz, and the frequency band of the amplifier 33 is from 2 to 12 kHz.

It can be seen from FIG. 7 that the marker response observed at the input of the analog/digital converter (ADC) 34 has characteristic spikes 730 and 740 of opposite polarities, in each half of the main frequency period. This waveform 720 is digitized by ADC and then processed by digital signal processor 35. Preferably, the data processing method is based on comparing the received signal with a pre-determined or empirically obtained, model function of the marker response. For experimentally building such model, the marker response is measured and averaged for a number of markers or marker types on a real system sample, when the marker is placed within the detection zone. The comparison to the pre-determined model approach allows using a higher portion of the received signal energy for the analysis, rather than the relatively low energy contained in one or several harmonics, as is presently practiced in the art.

The digitized signal data are sampled for several periods each phase state (ORT, FLAT of FRONT). Then, correlation of signal to the pre-determined model is calculated, for example, by a "sliding window" method. In this method, the sampled data in each of the periods are approximated by the pre-determined model function on a pre-set time interval (window) that is approximately equal to the duration of the marker re-magnetization. This window is moved along the period, and the calculations are repeated. Clearly, the scaling coefficient of the approximation will be at maximum when the window coincides with the marker spike, and it will be nearly zero in other window positions. furthermore, the phases of the marker spikes in several sequential periods of the same field state (ORT, FLAT or FRONT) are very close in timing (the speed of the marker movement through the aisle is small in comparison with the ratio of the antenna width to the main frequency period). Therefore, correlation criteria can be accumulated for the windows of the same phase, if the marker spikes are present in these windows. On the contrary, the interference spikes are unlikely to appear in every period with identical phases, unless this is a periodical interference relative to the main frequency. The latter case can be treated as a background, and the digitized data can be corrected accordingly.

When the statistical criteria of the marker detection will be greater than the pre-set threshold value, the digital signal processor 35 will activate the alarm unit.

The principles taught by the present invention may clearly be applied in other types of EAS systems like radio frequency (RF) or acousto-magnetic (AM) transceiver systems.

It will be appreciated that the invention is not limited to what has been described hereinabove merely by way of example. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

What is claimed is:

1. An apparatus for detecting the presence of a marker in an interrogation zone, the apparatus comprising:

two substantially parallel antennae arrays forming an interrogation zone therebetween, each array comprising at least two substantially coplanar antennae elements, each antennae element comprising at least a transmitting coil so as to provide each of said antennae arrays with at least two transmitting coils;

a phase sequencer coupled to said transmitting coils and adapted to feed current thereto in accordance with a plurality of varying phase patterns, for affecting varying spatial orientation of a magnetic field in an interrogation zone between said antennae arrays;

wherein said phasing sequencer switches between the phase patterns, in a time dependent fashion.

2. The apparatus of claim 1 wherein said phase sequencer further comprises a processing unit, and software controlling said processing unit, for controlling the operation of said phase sequencer.

3. The apparatus of claim 2 wherein said processing unit comprises a digital signal processor.

4. The apparatus of claim 1 wherein said phase patterns are selected to produce magnetic field orientation selected from a group consisting of orthogonal orientation, front orientation and flat orientation.

5. The apparatus of claim 1 wherein at least one of said antennae elements further comprises a receiving coil.

6. The apparatus of claim 5, further comprising of a receiver coupled to said receiving coil, said receiver comprising a signal processor adapted to analyze signals received by said receiving coil, for determining if a marker is present within said interrogation zone.

7. The apparatus of claim 6, wherein said signal processor is adapted to detect signals generated by magnetization of markers having low magnetic coercivity and high magnetic permeability.

8. An apparatus for detecting the presence of a marker in an interrogation zone, the apparatus comprising:

two substantially parallel antennae arrays forming an interrogation zone therebetween, each array comprising at least two substantially coplanar antennae elements, each antennae element comprising a transmitting coil so as to provide each of said antennae arrays with at least two transmitting coils, a receiving coil located in pre-determined proximity to said transmitting coil, and a compensator coil located in closer proximity to said transmitting coil than said receiving coil, and wherein the receiving coil and compensator coil are coupled therebetween in opposite polarity, forming a receiving element;

a phase sequencer coupled to said transmitting coils and adapted to feed current thereto in accordance with a plurality of varying phase patterns, for affecting varying spatial orientation of a magnetic field in an interrogation zone between said antennae arrays;

wherein said phasing sequencer switches between the phase patterns, in a time dependent fashion.

9. The apparatus of claim 8, wherein the receiving coil is characterized by having a larger number of turns than that of said compensating coil.

10. The apparatus of claim 8, further comprising a receiver and a signal processor, said receiver adapted to couple to said receiving element for receiving an input signal, said receiver adapted to process said signal input and feed the processed signal to said signal processor adapted to analyze said signal input to determine if a marker is present in said interrogation zone.

11. The apparatus of claim 10, further comprises model reflecting expected marker response, and wherein said signal processor is constructed to perform a comparison between said processed signal to said model.

12. The apparatus of claim 11 wherein said comparison is performed using a sliding window method.

13. The apparatus of claim 10, wherein said receiver is integrated within said signal processor.

14. The apparatus of claim 10 wherein said signal processor comprises a digital signal processor.

15. The apparatus of claim 10, wherein input signals are received from a plurality of receiving elements; said input signal are amplified and added to each other so as to produce a signal comprising a sum of absolute values of the input signals, and wherein said sum is fed to said signal processor for analysis.

16. The apparatus of claim 10, wherein said signal processor is adapted to detect a marker characterized by low magnetic coercivity and high magnetic permeability.

17. The apparatus of claim 16, wherein said marker having a magnetic permeability higher than 20,000 $\mu_0$.

18. The method of claim 17 wherein said step of sensing is performed utilizing a receiving coil located at a predetermined distance from said transmitting coil, and a compensating coil located at a smaller distance to said transmitting coil; wherein said compensating coil has a lower number of turns than said receiving coil; and wherein the output of said receiving coil is coupled to the output of said compensating coil at opposite polarity.

19. The method of claim 17, wherein said step of analyzing further comprises the step of comparing received magnetic field perturbations to a computer model of expected response from a marker in the interrogation zone.

20. A method of detecting a marker within an interrogation zone, the method comprising the steps of:

feeding current to a plurality of transmitting coils in varying phase patterns, wherein a first pair of transmitting coils are co-planarily arranged in a first antennae array, and a second pair of transmitting coils are co-planarily arranged in a second antennae array, substantially parallel to said first antennae array, and forming an interrogation zone therebetween, wherein said phase patterns are selected to cause a different spatial orientation of the magnetic field in said interrogation zone for specific different phase patterns;

Modifying said phase patterns in a time dependent manner;

sensing magnetic perturbations caused by the presence of a marker in the interrogation zone;

analyzing signals resulting from said sensing; and, outputting an indication if said step of analysis determines that a marker is present within the interrogation zone.

21. The method of claim 20 wherein said step of sensing is performed utilizing a plurality of receiving coils, further comprising the step of adding absolute values of output signals from said receiving coils, and wherein the result of said step of adding is utilized as input to said step of analyzing.

* * * * *

UNITED STATES PATENT AND TRADEMARK OFFICE

CERTIFICATE OF CORRECTION

PATENT NO. : 6,836,216 B2
DATED : December 28, 2004
INVENTOR(S) : Manov et al.

It is certified that error appears in the above-identified patent and that said Letters Patent is hereby corrected as shown below:

Title page,
Item [75], Inventors, after "[75] inventors" and before "Vladimir Manov" insert
-- Vladimir Malyshev, Moscow (RU); --

Signed and Sealed this

Twenty-ninth Day of March, 2005

JON W. DUDAS
*Director of the United States Patent and Trademark Office*